US011136763B2

(12) United States Patent
Repasky

(10) Patent No.: US 11,136,763 B2
(45) Date of Patent: Oct. 5, 2021

(54) AERODYNAMICALLY STABLE ROOF PAVER SYSTEM AND BALLAST BLOCK THEREFOR

(71) Applicant: Hanover Prest-Paving Company, Hanover, PA (US)

(72) Inventor: John Repasky, Hanover, PA (US)

(73) Assignee: Hanover Prest-Paving Company, Hanover, PA (US)

( * ) Notice: Subject to any disclaimer, the term of this patent is extended or adjusted under 35 U.S.C. 154(b) by 0 days.

(21) Appl. No.: 15/967,934

(22) Filed: May 1, 2018

(65) Prior Publication Data

US 2019/0338526 A1 Nov. 7, 2019

(51) Int. Cl.

| | |
|---|---|
| ***E04D 5/06*** | (2006.01) |
| ***E04D 13/12*** | (2006.01) |
| ***E04D 11/02*** | (2006.01) |
| *E04F 15/02* | (2006.01) |
| *E04F 15/08* | (2006.01) |

(52) U.S. Cl.

CPC ..... *E04D 13/12* (2013.01); *E04D 5/06* (2013.01); *E04D 11/02* (2013.01); *E04F 15/02038* (2013.01); *E04F 15/02183* (2013.01); *E04F 15/08* (2013.01); *E04F 2201/0107* (2013.01); *E04F 2201/023* (2013.01); *E04F 2201/043* (2013.01); *E04F 2203/00* (2013.01); *E04F 2290/044* (2013.01)

(58) Field of Classification Search

CPC ... E04B 2/18; E04B 2/08; E04B 11/00; E04B 2/46; E04B 1/185; E04C 1/40; E04D 13/12; E04D 11/02; E04D 5/06; E04D 13/04; E04D 13/17; E04D 13/0477; E04F 2201/0107; E04F 17/00; E04F 17/023

See application file for complete search history.

(56) References Cited

U.S. PATENT DOCUMENTS

| | | | | |
|---|---|---|---|---|
| 339,799 A | | 4/1886 | McAllister | |
| 576,569 A | | 2/1897 | Gemmer | |
| 721,751 A | | 3/1903 | Scott | |
| 774,276 A | | 11/1904 | Reiff | |
| 1,277,829 A | * | 9/1918 | Baum | E04B 2/14 52/607 |
| 1,397,035 A | | 11/1921 | Colosimo | |

(Continued)

OTHER PUBLICATIONS

Extended European Search Report, European Patent Application No. 19171508.5, dated Aug. 23, 2019, 7 pages.

(Continued)

*Primary Examiner* — Phi D A

(74) *Attorney, Agent, or Firm* — Barley Snyder

(57) ABSTRACT

A ballast block is provided with a body and a plurality of fluid receiving channels. The body includes a top surface, a bottom surface positioned opposite the top surface, and a first side extending between the top surface and the bottom surface. The plurality of fluid receiving channels are disposed along the first side in a plurality of units and extending from the top surface to the bottom surface to form a zigzag pattern. Each unit of the plurality of units having an adjacent pair of fluid receiving channels extending at opposing angles toward each other from the top surface to the bottom surface in an approximate V-shape.

21 Claims, 7 Drawing Sheets

(56) References Cited

U.S. PATENT DOCUMENTS 1,455,657 A * 5/1923 Pontello ..... E04D 13/17 138/115
1,495,896 A 5/1924 Ferguson
2,124,084 A 7/1938 Sauereisen
3,077,703 A 2/1963 Bergstrom
3,079,730 A 3/1963 Donegan
3,305,982 A 2/1967 Steele
3,382,632 A * 5/1968 Grofcsik ..... E04B 2/10 52/223.7
3,387,420 A 6/1968 Long
3,619,961 A 11/1971 Sterrett et al.
3,969,851 A 7/1976 Whitacre
4,019,298 A * 4/1977 Johnson, IV ..... E04B 1/185 52/590.1
4,115,980 A * 9/1978 Martel ..... E04B 2/46 446/124
4,274,238 A 6/1981 O'Riordain
4,506,483 A 3/1985 Phalen, Jr.
4,516,364 A * 5/1985 Heider ..... E04C 1/40 52/590.1
4,535,579 A 8/1985 Burgoyne et al.
4,640,071 A * 2/1987 Haener ..... E04B 2/46 52/100
4,655,018 A * 4/1987 Pardo ..... E04D 3/04 52/302.3
4,671,039 A * 6/1987 Hunt ..... E04B 2/18 52/562
4,798,036 A 1/1989 Pardo
4,823,530 A * 4/1989 Haring ..... E04B 1/945 52/232
4,943,185 A * 7/1990 McGuckin ..... E02B 11/00 210/170.07
4,977,730 A 12/1990 Pardo
5,035,532 A * 7/1991 Gargollo ..... E01C 5/00 404/41
5,070,669 A 12/1991 Tsai
5,365,714 A * 11/1994 Potvin ..... E04B 2/08 52/590.1
5,377,468 A 1/1995 Repasky
5,400,561 A * 3/1995 Metten ..... B28B 11/04 52/606
5,598,679 A * 2/1997 Orton ..... B28B 17/0027 405/284
5,887,397 A * 3/1999 Repasky ..... E04D 11/00 52/302.4
5,901,521 A * 5/1999 Guy ..... E04B 2/08 52/564
6,053,661 A * 4/2000 Lewis ..... E02B 11/00 405/258.1
6,679,022 B1 * 1/2004 Corporaal ..... E04B 2/08 52/590.2
7,694,485 B1 * 4/2010 Siener ..... E04B 2/18 52/570
8,123,435 B1 * 2/2012 DeShaw ..... E02B 3/14 405/15
8,336,269 B1 * 12/2012 Mollinger ..... E04F 13/007 428/167
8,424,261 B2 * 4/2013 Collier ..... E04B 2/18 52/309.12
9,109,390 B1 * 8/2015 Cavuoti ..... A47G 5/00
10,183,228 B2 * 1/2019 Kuo ..... A63H 33/082
2006/0150559 A1 * 7/2006 Haener ..... E04B 2/44 52/606
2013/0113127 A1 * 5/2013 Yang ..... F28F 9/0075 261/112.1
2019/0040589 A1 * 2/2019 Fanucci ..... E01C 5/22

OTHER PUBLICATIONS

Hanover Architectural Products, "Ventloc Interlocking Lightweight Roof Ballast", Jun. 26, 2017, pp. 1-3, http://web.archive.org/web/20170626231748/http://www.hanoverpavers.com/index.php/products/high-wind-solutions?layout=edit&id=248 (retrieved on Aug. 16, 2019).
Aia Dallas, "Columns Spring 2017 vol. 34 No. 2", Jan. 1, 2017, https://www.aiadallas.org/media/uploads/columns-docs/columns_spring_2017_final_0512.pdf (retrieved Aug. 16, 2019).
Hanover Architectural Products, "Ventloc Interlocking Lightweight Roof Ballast", Sep. 26, 2016, pp. 1-1, https://www.hanoverpavers.com/images/PDFs/1401-Ventloc_Dtl.pdf (retrieved Aug. 16, 2019).
Hanover Architectural Products, "Ventloc Product Data Sheet", Oct. 25, 2016, p. 1, https://www.hanoverpavers.com/images/PDFs/1403-Ventloc-Data-Sheet.pdf (retrieved Aug. 16, 2019).
European Patent Office Communication, dated Feb. 24, 2021, 5 pages.

* cited by examiner

AERODYNAMICALLY STABLE ROOF PAVER SYSTEM AND BALLAST BLOCK THEREFOR

FIELD OF THE INVENTION

The invention relates to a roof paver system and, more specifically, to a roof paver system having an aerodynamically stable ballast block.

BACKGROUND

Single-ply protected-membrane roof systems are generally known and are especially suitable for low-sloped roofs and decks. These systems typically include a single-ply water-impermeable membrane, with or without thermal insulation layers, held in place and protected from the elements by ballast systems of various designs. These systems may also include loose-laid, well-rounded stones such as river gravel, standard paving blocks, composite tongue-and-groove board, and lightweight interlocking ballast blocks. In general, conventional ballast systems are often used in areas where exposure to high wind conditions may be anticipated because they are capable of withstanding greater wind velocities than conventional built-up roofing systems.

Conventional ballast blocks are usually extruded or precast concrete of flat rectangular shape laid over a roof membrane in a contiguous grid pattern. However, even this construction does not assure dislodgement of the ballast blocks under certain weather conditions. High velocity winds, such as those of hurricane-force, passing over irregular or critical roof locations may induce an aerodynamic pressure differential across the conventional blocks to lift them out of place. Instead of simply making ballast blocks heavier and the roof supports stronger, various designs have evolved for resisting the lifting force, such as the aforementioned lightweight ballast blocks secured to each other by interlocking edges.

However, despite these design efforts, the net upward aerodynamic loading acting on the ballast blocks may lift them and present dangers to people and/or structures in the vicinity, as well as expose the underlying roof membrane and substructure to damage.

One such example that attempts to address these issues is an interlocking ballast block roofing system disclosed in U.S. Pat. No. 5,377,468. The '468 patent discloses a labyrinthine system of channels extending from a top side to a plurality of chambers positioned along a bottom side thereof. Additionally, the labyrinthine system of channels permits fluids to pass between adjacent blocks without direct exposure of underlying roofing materials to the elements.

While disclosed design solves some of the above problems, the known labyrinthine system of channels is aerodynamically problematic, as it includes a plurality of 90° turns within the channels that frictionally lower the efficiency of fluid flow from the top side to the chambers on the bottom side. Additionally, the complexity of the system of channels decreases the robustness of the manufacturing and installation process, by increasing the probability of damaging the system of channels.

Consequently, there is a need for an interlocking ballast block roofing system that improves upon conventional designs through more efficient fluid flow, such as water and air, and, while being robust during the manufacturing and installation process.

SUMMARY

A ballast block is provided with a body and a plurality of fluid receiving channels. The body includes a top surface, a bottom surface positioned opposite the top surface, and a first side extending between the top surface and the bottom surface. The plurality of fluid receiving channels are disposed along the first side in a plurality of units and extending from the top surface to the bottom surface to form a zigzag pattern. Each unit of the plurality of units having an adjacent pair of fluid receiving channels extending at opposing angles toward each other from the top surface to the bottom surface in an approximate V-shape.

BRIEF DESCRIPTION OF THE DRAWINGS

The invention will now be described by way of example, with reference to the accompanying Figures, of which.

DETAILED DESCRIPTION OF THE EMBODIMENT(S)

Now with reference to the Figures, an exemplary embodiment of the invention will be described.

Figure 1:
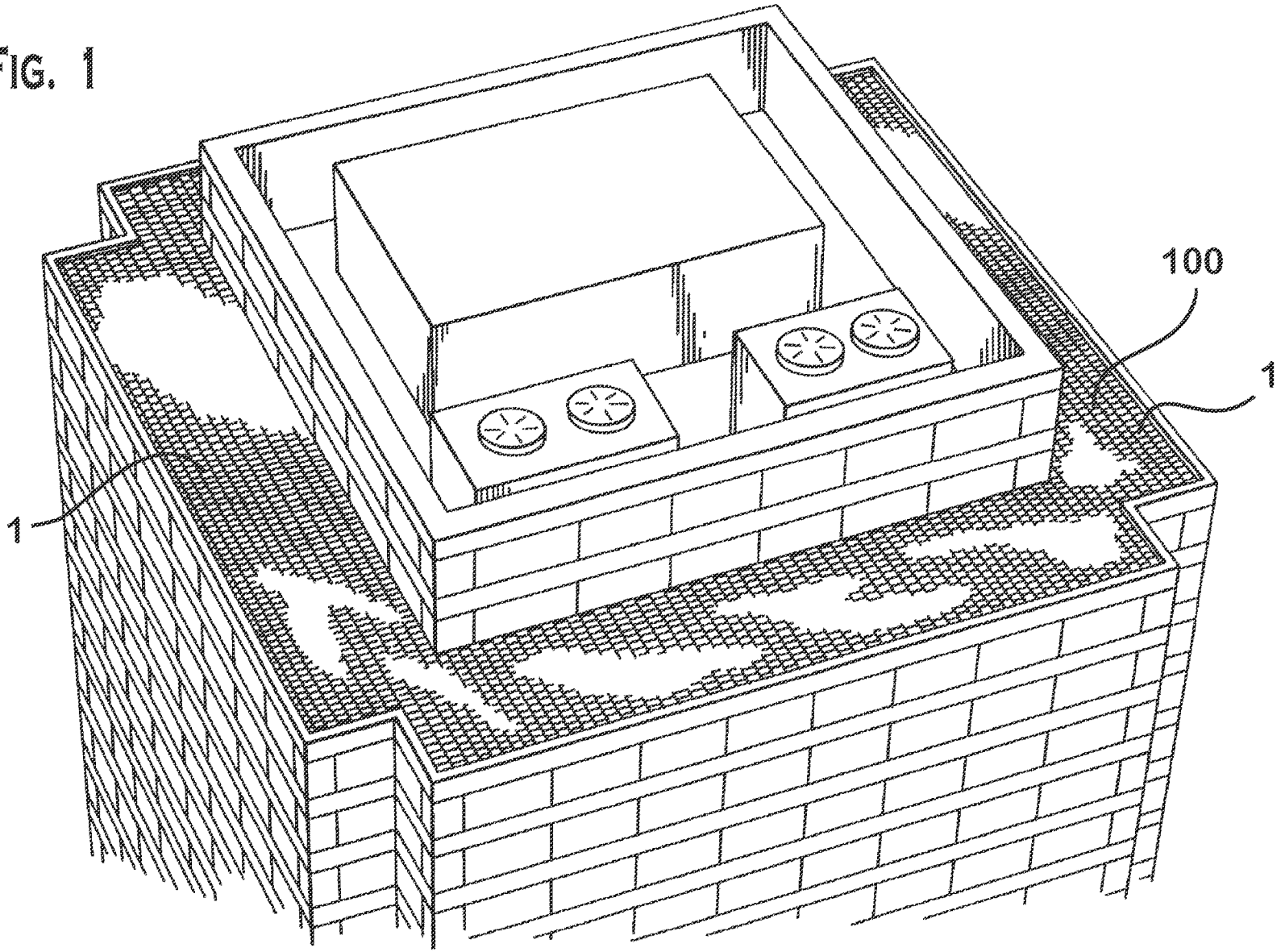
FIG. 1 is a schematic perspective view of a building having a roof paver system with interlocking ballast blocks according to the invention.

With respect to FIG. 1, a roof paver system 100 having a plurality of ballast blocks 1 according to the invention is shown. The roof paver system 100 may be disposed along a roof of a high-rise building, for instance, with the ballast blocks 1 arranged along a surface of the roof. However, one skilled in the art should appreciate that the roof paver system 100 could be utilized along other surfaces prone to outside environmental conditions, such as wind, rain, snow, and debris.

Now with respect to FIGS. 2-6, the ballast block 1 according to the invention will be described. In general, the ballast block 1 is polygonal in plan and, in particular, rectangular shaped in the shown embodiment. However, one skilled in the art should appreciate that other polygonal shapes are possible. In the shown embodiment, the ballast block 1 is molded of conventional roof ballast block concrete construction, but could be manufactured using other materials.

In an exemplary embodiment of the invention, the ballast block 1 includes a body 10, a plurality of legs 20, a plurality of fluid receiving chambers 30, and a plurality of fluid receiving channels 40.

Now with respect to FIGS. 2-6, the body 10 will be described. As shown, the body 10 includes a top surface 11, a bottom surface 12, a first side 13, a second side 14, a third side 15, and a fourth side 16. The top surface 11 and the bottom surface 12 are opposed major surfaces of the body 10. In the shown embodiment, the top surface 11 and the bottom surface 12 are substantially planar. However, one skilled in that art should appreciate, that the top surface 11 or bottom surface 12 may include irregularities, such as protrusions, patterns, and/or depressions. For instance, the top surface 11 may include non-slip properties and raised truncated domes.

The first side 13 is substantially perpendicular to the top surface 11 and the bottom surface 12 and extends widthwise there between. A major surface of the first side 13 is substantially planar. The second side 14 extends substantially perpendicular to the top surface 11 and the bottom surface 12 and extends widthwise there between. The second side 14 is positioned opposite the first side 13 and approximately parallel to the planar major surface of the first side 13. In the shown embodiment, the second side 14 has a length approximately equal to the length of the first side 13, and a surface of the second side 13 is substantially planar.

The third side 15 extends substantially perpendicular to the top surface 11 and the bottom surface 12, and extends widthwise there between. The third side 15 also extends substantially perpendicular to the first side 13 and the second side 14, and extends lengthwise there between.

The fourth side 16 extends substantially perpendicular to the top surface 11 and the bottom surface 12, and extends widthwise there between. The fourth side 16 also extends substantially perpendicular to the first side 13 and the second side 14, and extends lengthwise there between. Additionally, the fourth side 16 is opposite the third side 15 and approximately parallel to the third side 15. The fourth side 16 has a length approximately equal to the length of the third side 13.

Now with reference to FIGS. 3-6, the plurality of legs 20 will be described.

As shown, the plurality of legs 20 are positioned along the bottom surface 12 and extend away from the body 10. Each leg 20 provides space between the bottom surface 12 and an underlying support surface (described in detail below). In the shown embodiment, each leg 20 is generally rectangular and extends along the bottom surface 12, from first side 13 to the second side 14. The plurality of legs 20 are positioned substantially parallel to each other in the shown embodiment. A first facing end 21 of each leg 20 is beveled, sloping away from first side 13, towards the second side 14. In the shown embodiment, the first facing end 21 extends to the surface of the first side 13. In another embodiment, it is possible that the first facing end 21 is spaced a distance from the surface of the first side 13, such that a portion of the bottom surface 12 is positioned between the surface of the first side 13 and the first facing end 21.

A second facing end 22 of each leg 20 extends to the second side 14, such that the second facing end 22 is flush with the surface of the second side 14, in approximately the same plane.

Each leg 20 includes a first longitudinal sidewall 23*a* and an opposite second longitudinal sidewall 23*b* extending lengthwise on each side of the leg 20. The width of the first and second longitudinal sidewalls 23*a*, 23*b* is approximately equal, and determines the distance each leg 20 extends from the surface of the body 10. In the shown embodiment, the first longitudinal sidewall 23*a* and the second longitudinal sidewall 23*b* are beveled, extending at an angle from the bottom surface 12, towards each other. However, one skilled in the art should appreciate that in another embodiment, the first longitudinal sidewall 23*a* and the second longitudinal sidewall 23*b* may extend approximately perpendicular to the bottom surface 12, parallel to each other, with a 90 degree angle of intersection provided by the leg 20 and bottom surface 12. Also, in other embodiments, each legs Now with reference to FIGS. 3-5, the plurality of fluid receiving chambers 30 will be described.

As shown, the plurality of fluid receiving chambers 30 are positioned between the legs 20 and defined by the first and second longitudinal sidewalls 23*a*, 24*b* of the legs 20 and the bottom surface 12. As shown, each fluid receiving chamber 30 extends along the length of legs 20, from the first side 13 to the second side 14. Each fluid receiving chamber 30 is open on both the first side 13 and the second side 14.

Now with reference to FIGS. 2-4, the plurality of fluid receiving channels 40 will be described.

As shown, the pluralities of fluid receiving channels 40 are disposed along the first side 13 of the body 10. Adjacent pairs of channels 40 are positioned in units 17, and form a zigzag pattern in the shown embodiment. That is, each unit 17 includes a pair of adjacent channels 40 extending at opposing angles toward each other from the top surface 11 to the bottom surface 12 in an approximate V-shape. The zigzag pattern extends along the length of the first side 13. In the shown embodiment, the first side 13 includes 3, 4, 5, or more units 17 of adjacent pairs of channels 40. A distance between the pair of adjacent channels 40 of the unit 17 along the top surface 11 is greater than a distance between the pair of channels 40 along the bottom surface 12. Each channel 40 has a first width on a top surface end 41 that tapers down along the length of the channel 40 to a smaller second width on a bottom surface end 42.

An upper flat portion 80 and a beveled lower portion 81 are provided between each pair of adjacent channels 40 of the unit 17, above described V-shape. The upper flat portion 80 extends between the top surface ends 41 of the adjacent channels 40, and generally includes flat surface along a plane of the first side 13. The beveled lower portion 81 extends from an approximate mid-point along the length of the pair of adjacent channels 40 of the unit 17, inward, towards the bottom surface end 42 of the channels 40 of the unit 17.

Figure 2:
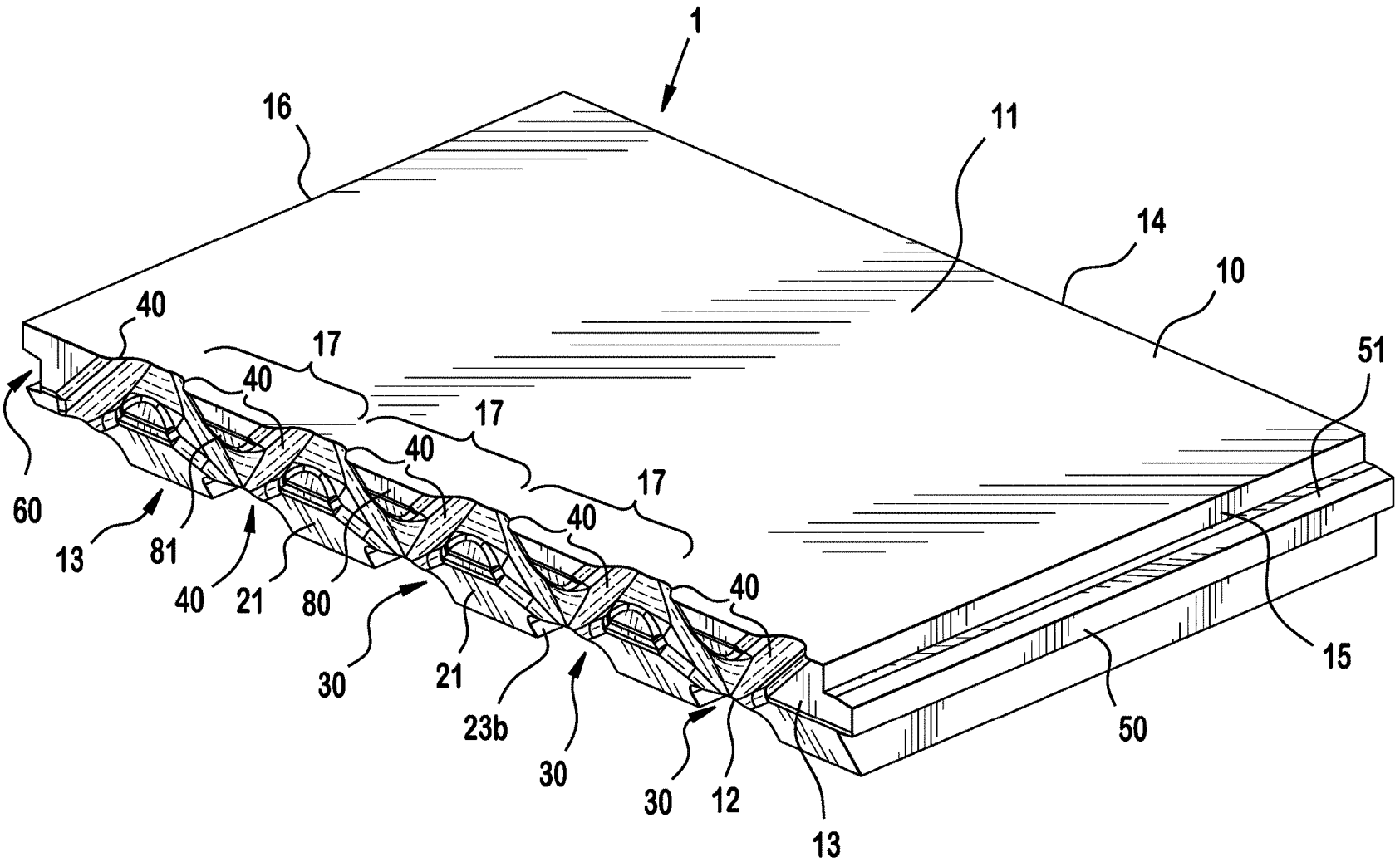
FIG. 2 is a top right perceptive view of a ballast block according to the invention.
Figure 3:
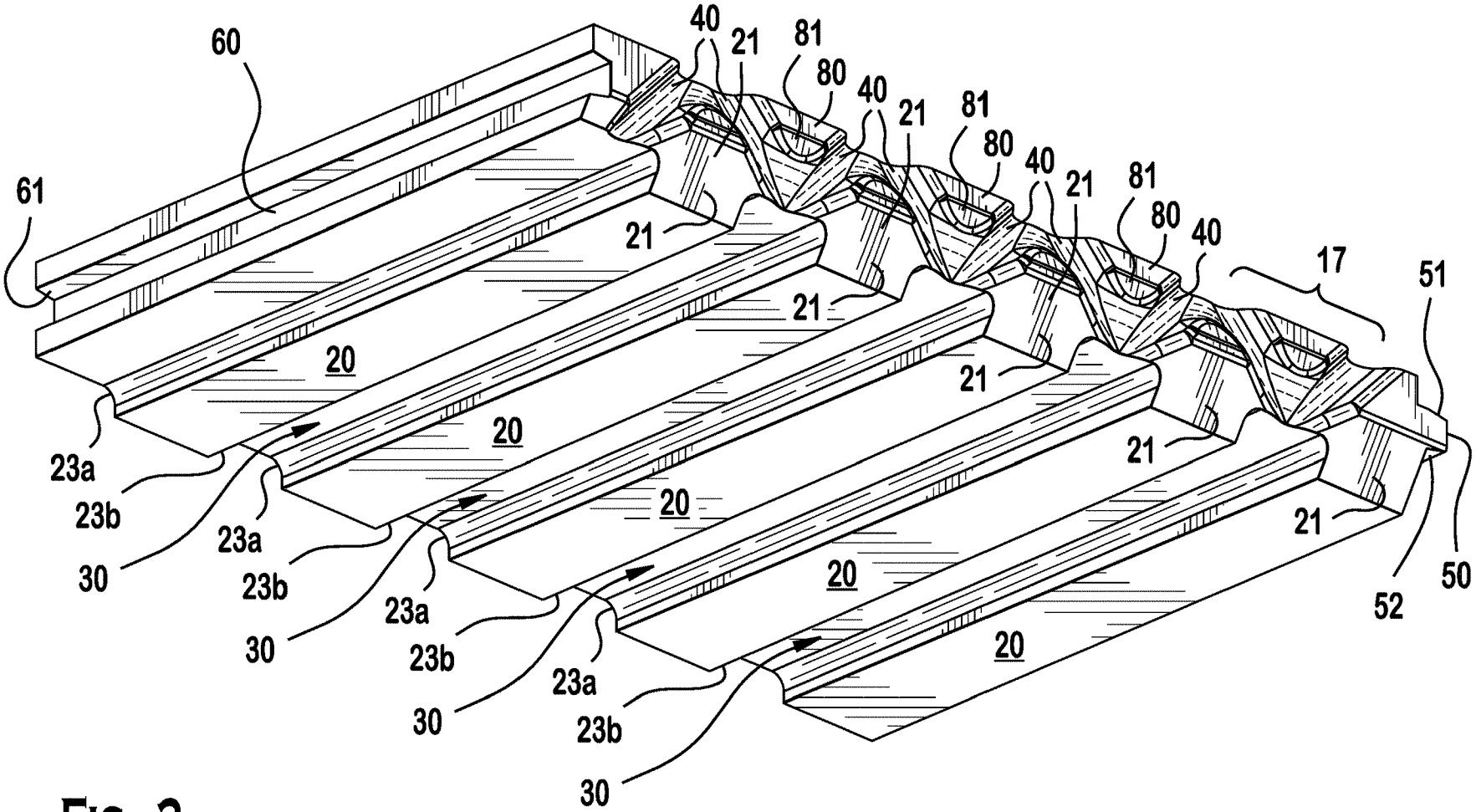
FIG. 3 is a bottom left perspective view of the ballast block of FIG. 2.
Figure 4:
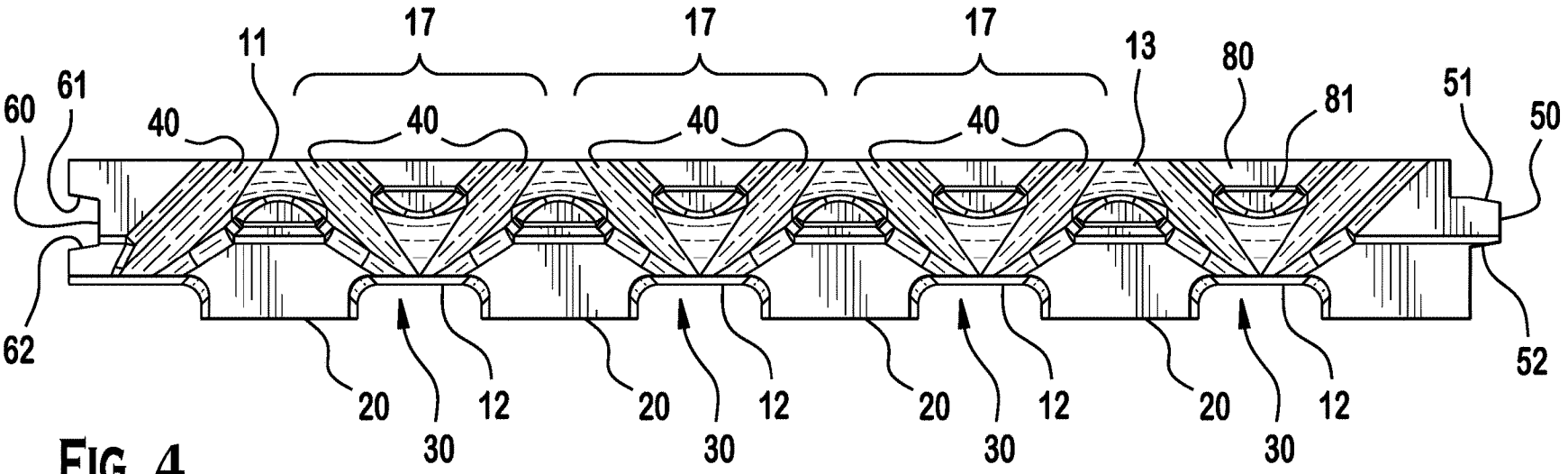
FIG. 4 is a front elevation view of the ballast block of FIG. 2.
Figure 5:
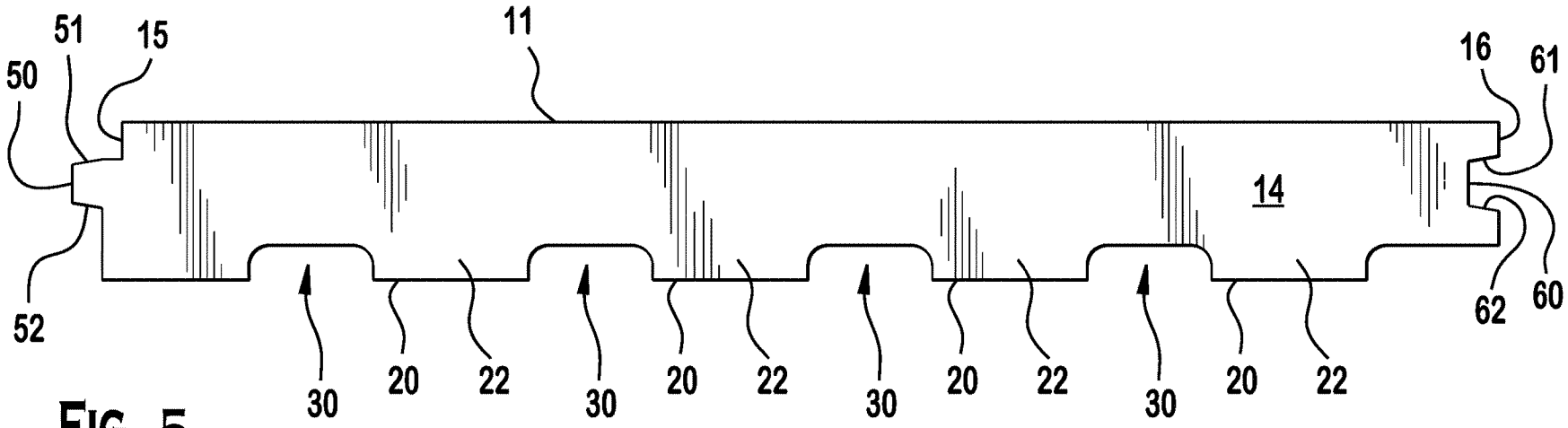
FIG. 5 is a rear elevation view of the ballast block of FIG. 2.
Figure 6:
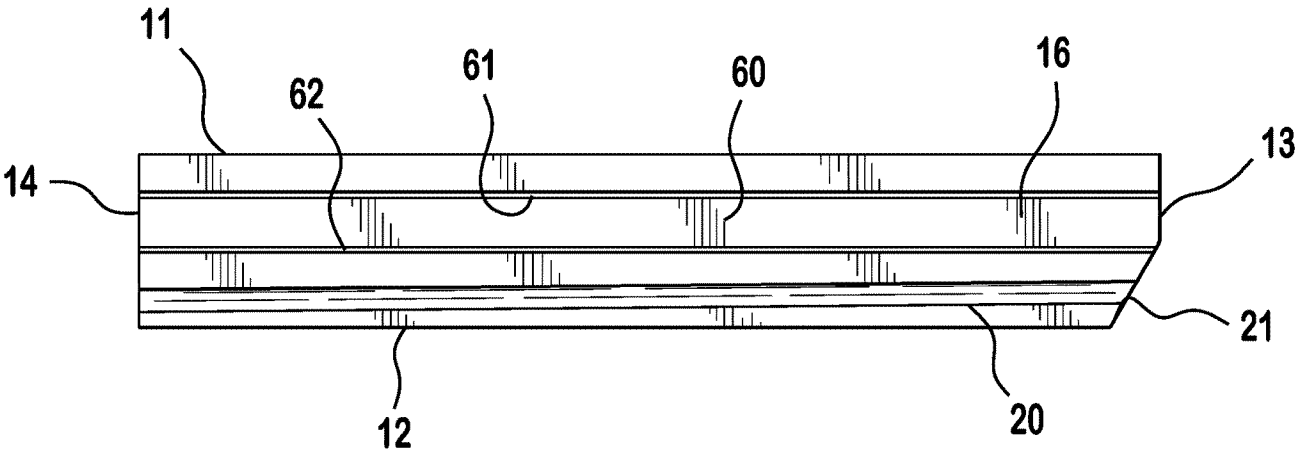
FIG. 6 is a left elevation view of the ballast block of FIG. 2.

As shown in FIGS. 2-4, the bottom surface ends 42 of each unit 17 of adjacent pairs channels 40 are in fluid communication with the fluid receiving chambers 30.

As shown in FIGS. 2-5, a tongue 50 is disposed along one side of the body 10. In the shown embodiment, the tongue 50 is positioned along the length of the third side 15, protruding outward from a surface of the third side 15. The tongue 50 has a top facing surface 51 and a bottom facing surface 52. In the shown embodiment, a length of the top facing surface 51 is greater than a length of the bottom facing surface 52. In another embodiment, the length of the top facing surface 51 is approximately equal to the length of the bottom facing surface 52. In an exemplary embodiment, the tongue 50 is tapered, such that the top facing surface 51 and the bottom facing surface 52 are angled toward each other. In another embodiment, the top facing surface 51 extends substantially parallel to the bottom facing surface 52.

As shown in FIGS. 2-5, a groove 60 is also provided along the body 10 and compliments the tongue 50. The groove 60 is disposed along the length of the fourth side 16, and is shaped complementary with respect to the tongue 50. The groove 60 includes an upper sidewall 61 that is complementary to the top facing surface 51 of the tongue 50, and a lower sidewall 62 that is complementary to the bottom facing surface 52 of the tongue 50. In the shown embodiment, a length of the upper sidewall 61 is equal to a length of the lower sidewall 62. In another embodiment, the length of the upper sidewall 61 is greater than or less than the length of the lower sidewall 62.

Now with reference to FIGS. 7-10, a description of the roof paver system 100 and an assembly thereof will be described.

Figure 7:
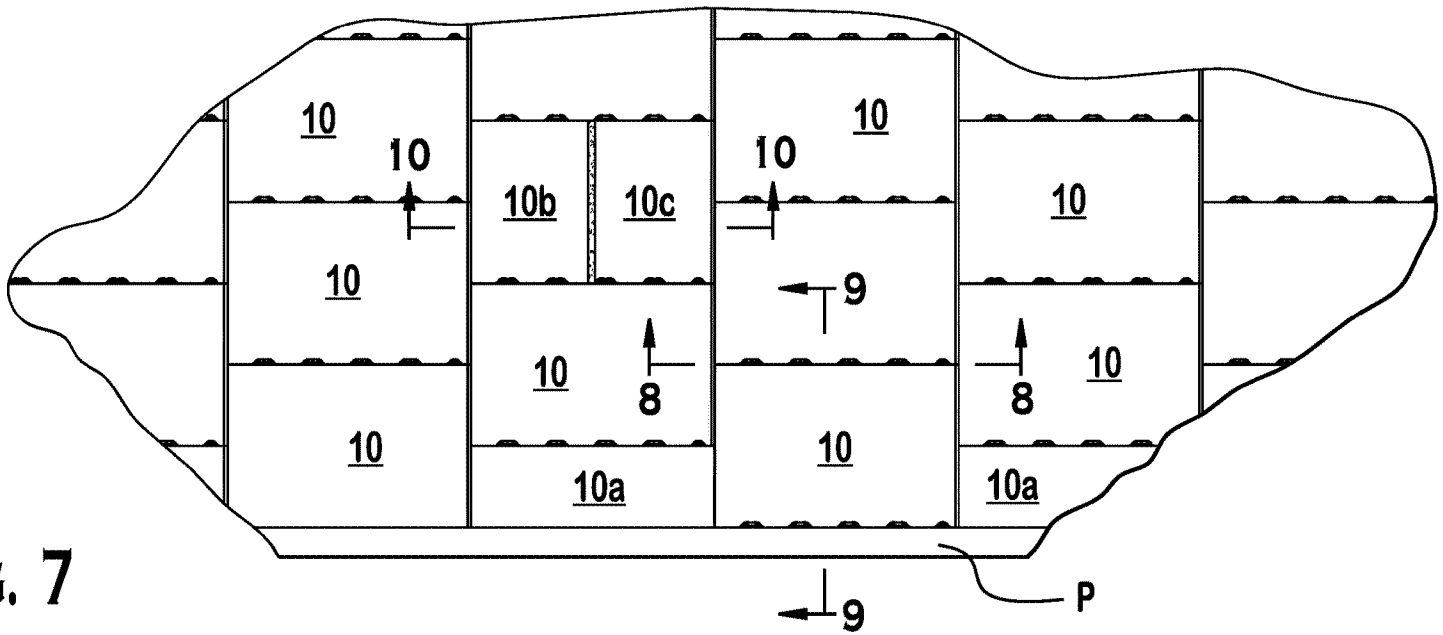
FIG. 7 is a plan view of ballast blocks in a section of the roof paver system.

As shown, the roof paver system 100 in an exemplary embodiment uses ballast blocks 1 according to the invention arranged in a pattern. As shown in FIG. 7, the ballast blocks 1 are positioned in like orientation in contiguous rows, with each ballast blocks 1 in a row staggered laterally in side-by-side interlocked relation with ballast blocks 1 in adjacent rows. In the shown embodiment, the ballast blocks 1 sit along a roof on top of an underlying support surface, such as a water-impermeable membrane, M. When ends of rows have insufficient space for a full size ballast block 1, such as at roof parapet P, use the ballast block may be modified into a narrowed block 1*a*. Damaged ballast blocks 1 in an existing installation can be replaced, as shown, with complementary half blocks 1*b* and 1*c*.

In the shown embodiment, the underlying support surface may include a water-impermeable membrane, M, such as single-ply PVC sheet, insulation I, and a water-proofing layer W. However, other conventional multi-component underlying support surface systems are contemplated for use with the roof paver system 100, depending on design requirements, such as conditions of use, building codes, and the like. In shown embodiment, the legs 20 of the ballast blocks 1 rest on the roof membrane M, where the membrane M further defines a fourth side of the fluid receiving chambers 30.

The ballast blocks 1 are positioned in adjacent rows and interlock at their complementary tongue 50 and groove 60 on the third and fourth side 16, respectively, of two ballast blocks 1 in the adjacent row. Hence, the laid ballast blocks 1 interact with one another to resist usual lifting forces.

With adjacent ballast blocks 1 supported on the membrane M, the flat second side 14 of one adjacent ballast block 1 abuts the first side 13 of an adjacent ballast block 1. Water drainage and airflow pathways formed across the surface of the first side 13 by the combination of the fluid receiving channels 40 with the fluid receiving chambers 30 between the bottom surface 12 of the body 10 and the membrane M, are shown by arrows A in FIG. 8. With adjacent ballast blocks 1 supported on the membrane M, and the flat second side 14 of one ballast block 1 abutting the channeled surface of the first side 13 of an adjacent ballast block 1, water will drain from the top surface 11 of the ballast block 1, through to the fluid receiving chambers 30. Further, the pathways provide continuous ventilation in the chambers 30 under the ballast blocks 1 for minimizing any aerodynamically induced pressure differential between the top and bottom surfaces 11,12 of the ballast blocks 1. Additionally, as shown by the arrows AA in the embodiment of FIG. 8, since the first facing end 21 of each leg 20 is beveled, fluid communication between all of the chambers 30 and units 17 is achieved along the entire length of the first side 13. Thus, when installed as described in the embodiments above, the ballast blocks 1 provide an aerodynamically stable roof paver system 100.

Figure 8:
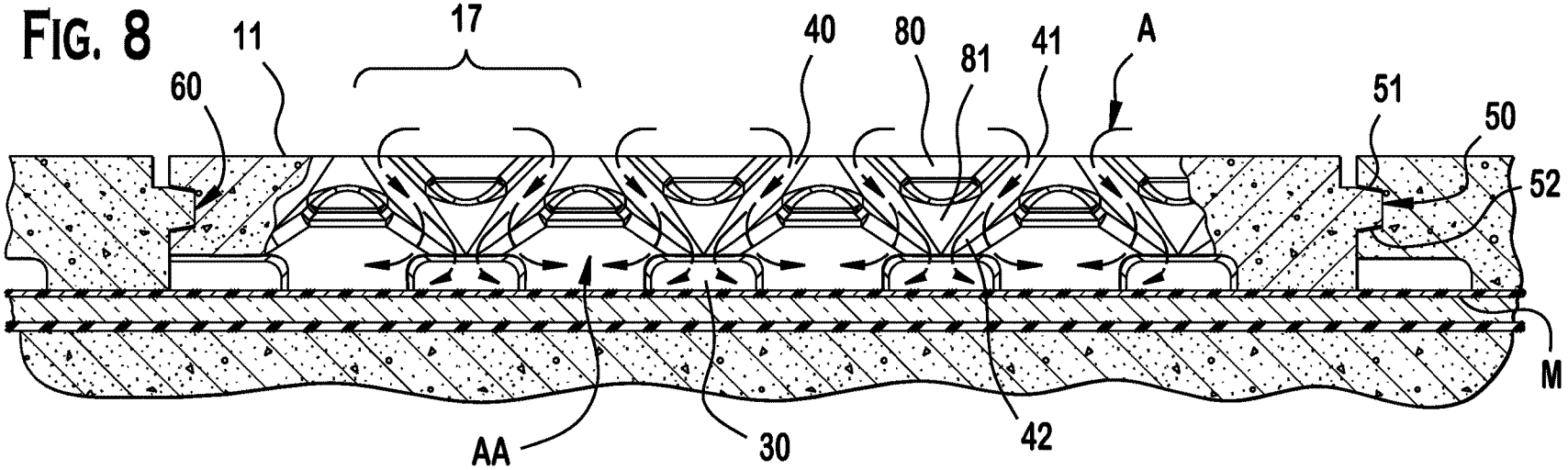
FIG. 8 is a partial sectional view of the roof paver system taken along the line 3-3 of FIG. 7.
Figure 9:
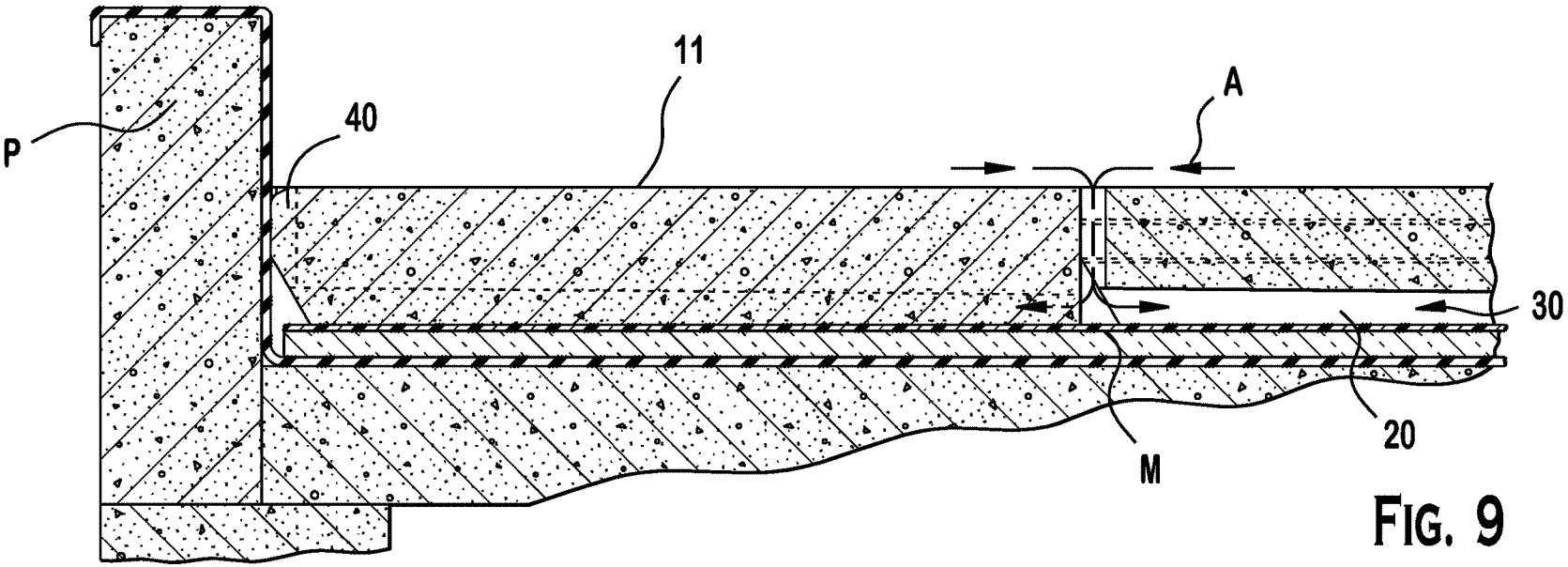
FIG. 9 is a partial section view of the roof paver system taken along the line 4-4 of FIG. 7.
Figure 10:
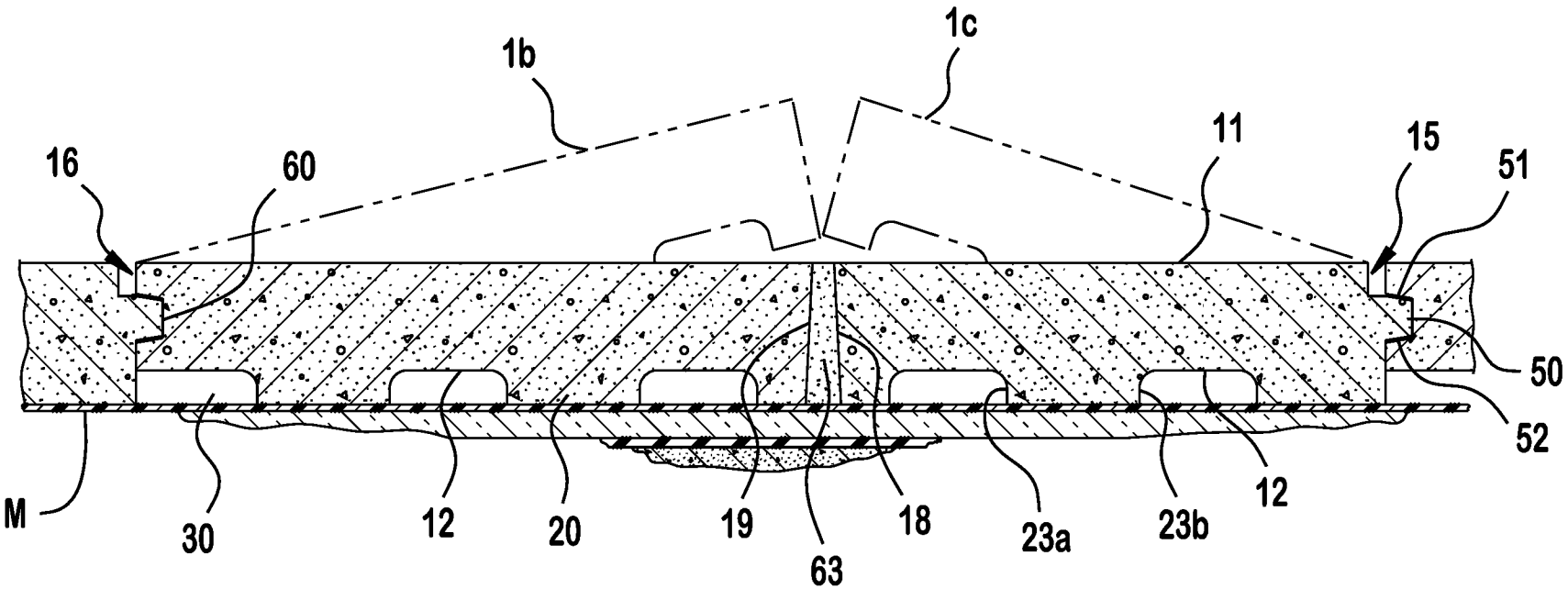
FIG. 10 is a sectional view of the roof paver system taken along the line 7-7 of FIG. 7.

In the shown embodiment of FIGS. 8-10, damaged ballast blocks 1 can be readily replaced. Ballast blocks 1 which become damaged after being laid in place, can be easily broken out and replaced by sectional replacement ballast blocks 1,1*c* without losing roof paver system 100 integrity. Each replacement ballast block 1*b*, 1*c* is dimensioned lengthwise slightly less than half the distance between the third side 15 and the fourth side 16. The complementary tongue 50 and groove 60 in replacement ballast blocks 1*b* and 1*c*, respectively, interlock with overlapping tongue 50 and grooves 60 of ballast blocks 1 in adjacent rows. In the shown embodiment of FIG. 10, beveled edges 18,19, opposite third and fourth sides 15,16, provide mutual clearance during installation of the replacement ballast blocks 1*b*, 1*c*, and provide space across the beveled edges 18,19 when installed to adhesive 63 to insure positive retention. In another embodiment, the beveled edges 18,19 are flat and parallel to each other when installed, have a gap there between, the gap providing installation clearance and a receiving space into which adhesive 63 can be applied.

The interlocking ballast blocks 1 according to the invention that cooperate with each other to provide an aerodynamically-stable roof paver system 100 suitable for unusual wind conditions. By arranging ballast blocks 1 in a row such that they interlock with ballast blocks 1 in adjacent rows, air and water readily flow between the ballast block 1 edges, the pressure in the fluid receiving chambers 30 is quickly equalized in response to a sudden reduction in air pressure above the ballast blocks 1. The tendency of the ballast blocks 1 to be displaced is therefore reduced.

Additionally, the ballast blocks 1 are lightweight, inexpensive to manufacture, and relatively easy to install or replace if they become damaged.

While embodiments of the ballast block and roof paver system have been described in detail, various modifications, alterations, and changes may be made without departing from the spirit and scope of the ballast block deck and roof paver system according to the present invention as defined in the appended claims.

What is claimed is:

1. A ballast block comprising:

a body having:

a top surface;

a bottom surface positioned opposite the top surface; and a first side extending between the top surface and the bottom surface; and, a plurality of fluid receiving channels disposed along the first side in a plurality of units and extending from the top surface to the bottom surface to form a zigzag pattern along an outer surface thereof, each unit of the plurality of units having an adjacent pair of fluid receiving channels extending at opposing angles toward each other from the top surface to the bottom surface in an approximate V-shape.

2. The ballast block of claim 1, wherein each of the plurality of fluid receiving channels has a first width positioned adjacent the top surface that tapers down along a length thereof to a second width positioned adjacent the bottom surface.

3. The ballast block of claim 1, wherein a first distance between the adjacent pair of fluid receiving channels along the top surface is greater than a second distance between the adjacent pair of fluid receiving channels along the bottom surface.

4. The ballast block of claim 1, wherein the unit forms a V-shaped area between the adjacent pair of fluid receiving channels and includes an upper flat portion and a beveled lower portion.

5. The ballast block of claim 4, wherein the upper flat portion extends between a top surface end of each of the adjacent pair of fluid receiving channels.

6. The ballast block of claim 3, wherein the beveled lower portion extends inward from an approximate mid-point along a length of the adjacent pair of fluid receiving channels in the unit towards a bottom surface end thereof.

7. The ballast block of claim 1, the body further comprising a second side extending widthwise substantially perpendicular to the top surface and the bottom surface, and positioned opposite the first side, with a substantially planar surface approximately parallel with a major surface side of the first side.

8. The ballast block of claim 7, the body further comprising a third side extending widthwise and substantially perpendicular to the top surface and the bottom surface, and positioned perpendicular to the first side and second side, extending lengthwise there between.

9. The ballast block of claim 8, further comprising a tongue extending along a length of the third side.

10. The ballast block of claim 9, wherein the tongue includes a top facing surface and a bottom facing surface.

11. The ballast block of claim 10, wherein a length of the top facing surface is greater than a length of the bottom facing surface.

12. The ballast block of claim 11, wherein the top facing surface and the bottom facing surface are tapered and extend at an angle toward each other.

13. The ballast block of claim 10, the body further comprising a fourth side extending widthwise and substantially perpendicular to the top surface and the bottom surface, perpendicular to the first side and second side, extending lengthwise there between, and opposite the third side.

14. The ballast block of claim 13, wherein the fourth side includes a groove disposed along a length thereof and complementary shaped to the tongue.

15. The ballast block of claim 14, wherein the groove includes an upper sidewall complementary to the top facing surface of the tongue, and a lower sidewall that is complementary to the bottom facing surface of the tongue.

16. The ballast block of claim 1, wherein the body further comprises a plurality of legs positioned along the bottom surface and extending from the first side to the second side.

17. The ballast block of claim 16, wherein each leg has a beveled first facing end sloping away from the first side towards the second side.

18. The ballast block of claim 17, wherein the beveled first facing end is spaced a distance from a major surface side of the first side, such that a portion of the bottom surface is positioned between the major surface side of the first side and the beveled first facing end.

19. The ballast block of claim 16, wherein the body further comprises a plurality of fluid receiving chambers positioned between a pair of the plurality of legs in fluid communication with chambers.

20. The ballast block of claim 19, wherein each fluid receiving chamber extends along a length of the pair of the plurality of legs, and is open on both the first side and the second side.

21. A roof paver system comprising:

a plurality of laterally interlocked ballast blocks having a body having:

a top surface;

a bottom surface positioned opposite the top surface; and a first side extending between the top surface and the bottom surface; and, a plurality of fluid receiving channels disposed along the first side in a plurality of units and extending from the top surface to the bottom surface to form a zigzag pattern along an outer surface thereof, each unit of the plurality of units having an adjacent pair of fluid receiving channels extending at opposing angles toward each other in an approximate V-shape, and perpendicular with respect to the top surface and the bottom surface such that the pair of fluid receiving channels correspond with an adjacent block of the plurality of laterally interlocked ballast blocks.

* * * * *